US011119427B2

(12) United States Patent
Berger et al.

(10) Patent No.: US 11,119,427 B2
(45) Date of Patent: Sep. 14, 2021

(54) FLOW STRUCTURE FOR AN INK SUPPLY IN A LIQUID ELECTROPHOTOGRAPHIC DEVELOPER UNIT

(71) Applicant: HP INDIGO B.V., Amstelveen (NL)

(72) Inventors: Shachar Berger, Ness Ziona (IL); Ziv Yosef, Ness Ziona (IL); Sagie Shanun, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 49 days.

(21) Appl. No.: 16/605,745

(22) PCT Filed: Apr. 25, 2017

(86) PCT No.: PCT/EP2017/059760
§ 371 (c)(1),
(2) Date: Oct. 16, 2019

(87) PCT Pub. No.: WO2018/196955
PCT Pub. Date: Nov. 1, 2018

(65) Prior Publication Data

US 2021/0124288 A1 Apr. 29, 2021

(51) Int. Cl.
*G03G 15/10* (2006.01)

(52) U.S. Cl.
CPC ..... *G03G 15/104* (2013.01)

(58) Field of Classification Search
CPC ..... G03G 15/10; G03G 15/104; G03G 2215/0658
See application file for complete search history.

(56) References Cited

U.S. PATENT DOCUMENTS

| | | | | |
|---|---|---|---|---|
| 6,207,336 | B1 | 3/2001 | Itaya et al. | |
| 6,975,824 | B2 | 12/2005 | Park | |
| 7,544,458 | B2 | 6/2009 | Iraqi et al. | |
| 8,837,990 | B2 | 9/2014 | Nelson et al. | |
| 9,291,948 | B2 | 3/2016 | Tanner et al. | |
| 2007/0231013 | A1* | 10/2007 | Hasdai | G03G 15/10 399/241 |
| 2011/0249989 | A1 | 10/2011 | Levintant et al. | |
| 2012/0121282 | A1 | 5/2012 | Oba et al. | |
| 2012/0219325 | A1 | 8/2012 | Sasaki et al. | |

FOREIGN PATENT DOCUMENTS

CN 201974641 9/2011

OTHER PUBLICATIONS

DTG Digital, Apr. 19, 2013, Available at: < http://www.dtgdigital.com/Downloads/dtg%20viper%20user%20guide%20v2.pdf >.

* cited by examiner

*Primary Examiner* — Thomas S Giampaolo, II
(74) *Attorney, Agent, or Firm* — Dierker & Kavanaugh PC

(57) ABSTRACT

In one example, a flow structure for an ink supply in a liquid electrophotographic developer unit includes an elongated basin having a volume that shrinks progressively from an upstream part of the basin to a downstream part of the basin such that a rate of shrinkage increases towards the downstream part.

13 Claims, 9 Drawing Sheets

FLOW STRUCTURE FOR AN INK SUPPLY IN A LIQUID ELECTROPHOTOGRAPHIC DEVELOPER UNIT

BACKGROUND

Liquid electrophotographic (LEP) printing uses a special kind of ink to form images on paper and other print substrates. LEP ink usually includes charged polymer particles dispersed in a carrier liquid. The polymer particles are sometimes referred to as toner particles and, accordingly, LEP ink is sometimes called liquid toner. An LEP printing process involves placing an electrostatic pattern of the desired printed image on a photoconductor and developing the image by presenting a thin layer of LEP ink to the charged photoconductor. The ink may be presented to the photoconductor with a roller that is commonly referred to as a "developer roller." Charged toner particles in the ink adhere to the pattern of the desired image on the photoconductor. The ink image is transferred from the photoconductor to a print substrate, for example through a heated intermediate transfer member that evaporates much of the carrier liquid to dry the ink film before it is transferred to the print substrate.

DRAWINGS

Figure 1:
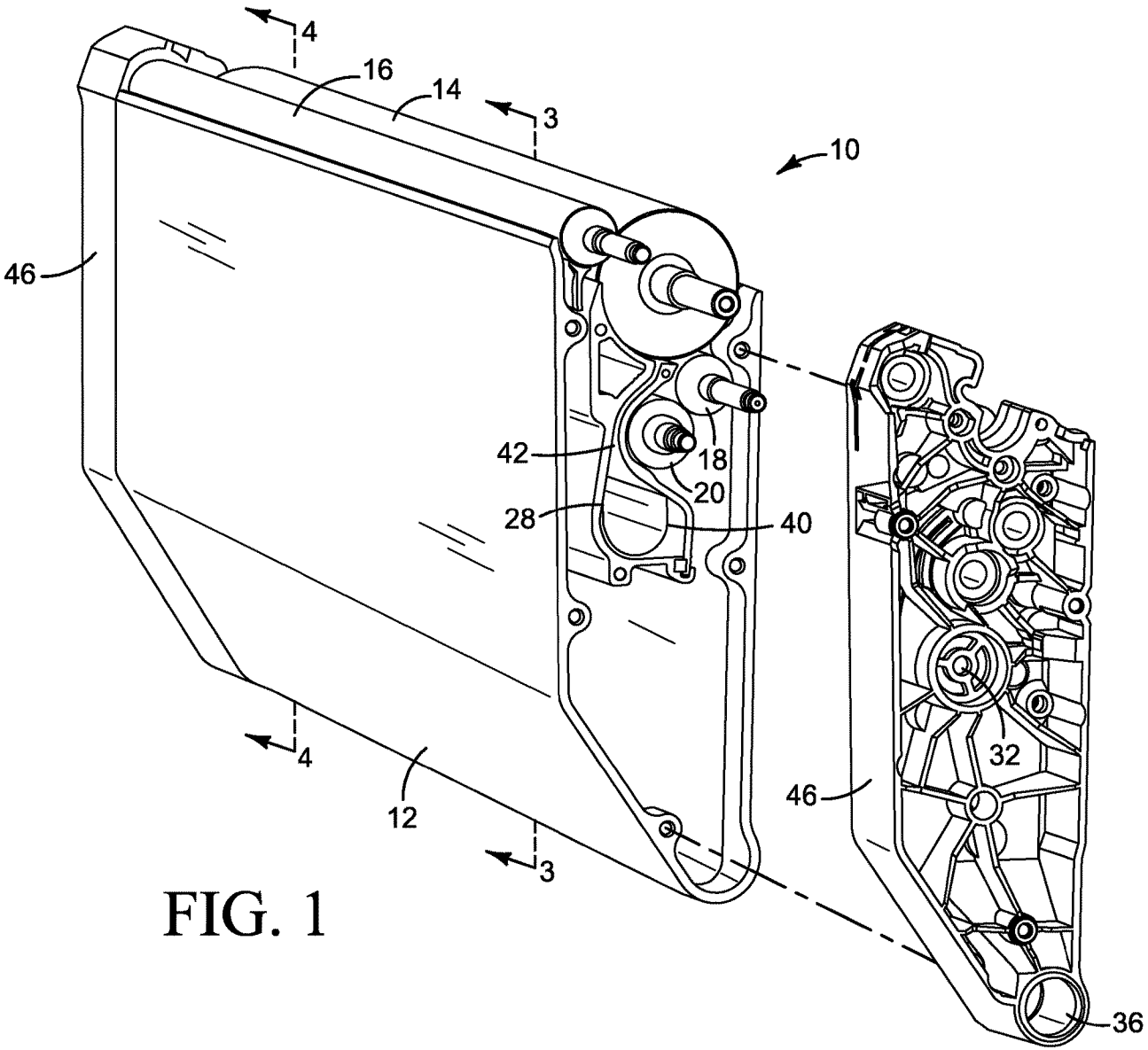
FIG. 1 is an isometric illustrating a developer unit for a liquid electrophotographic printer implementing one example of a new ink flow structure. One of the end caps is exploded in FIG. 1 to reveal the ink flow structure.
Figure 3:
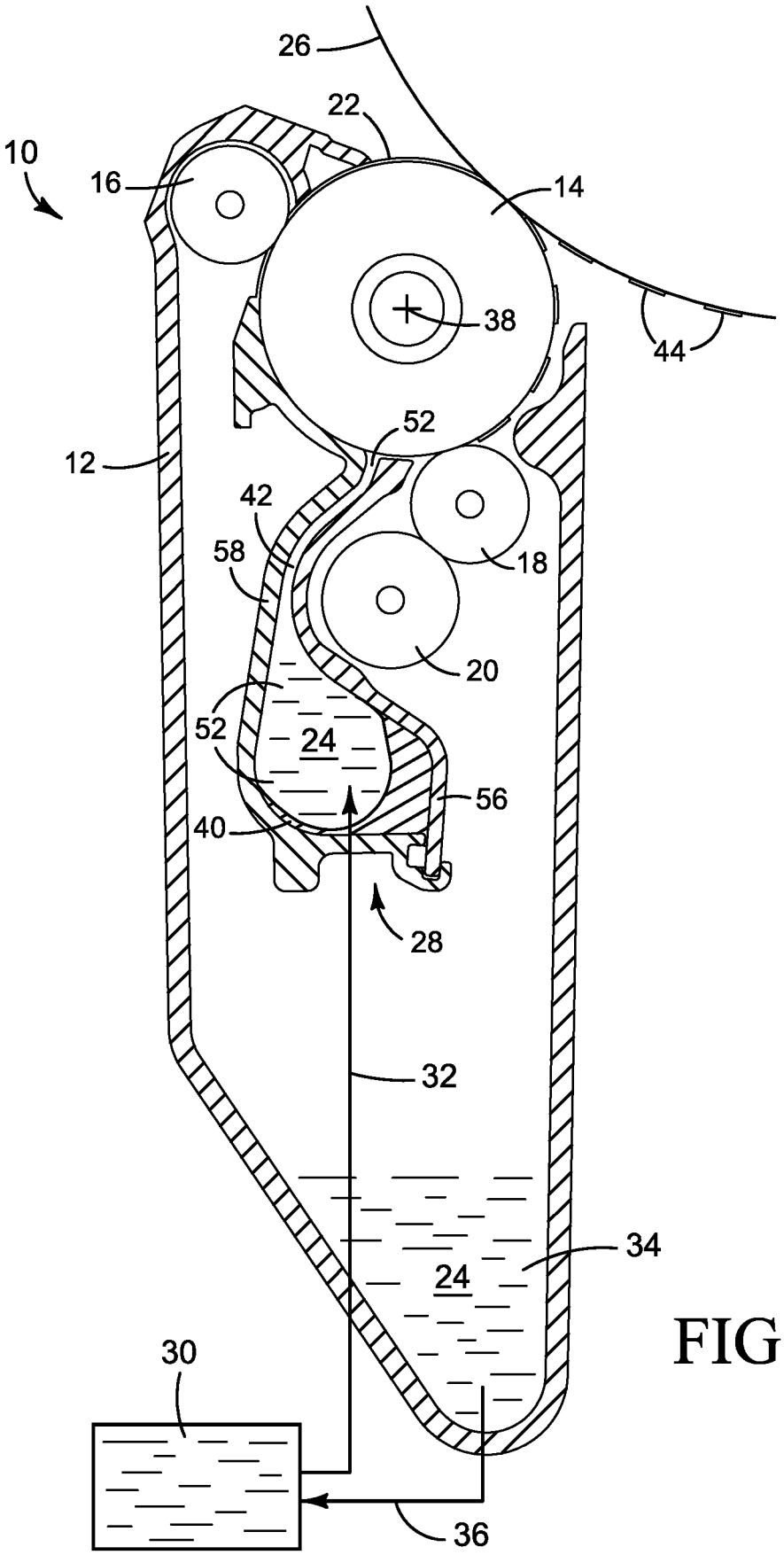
Figure 4:
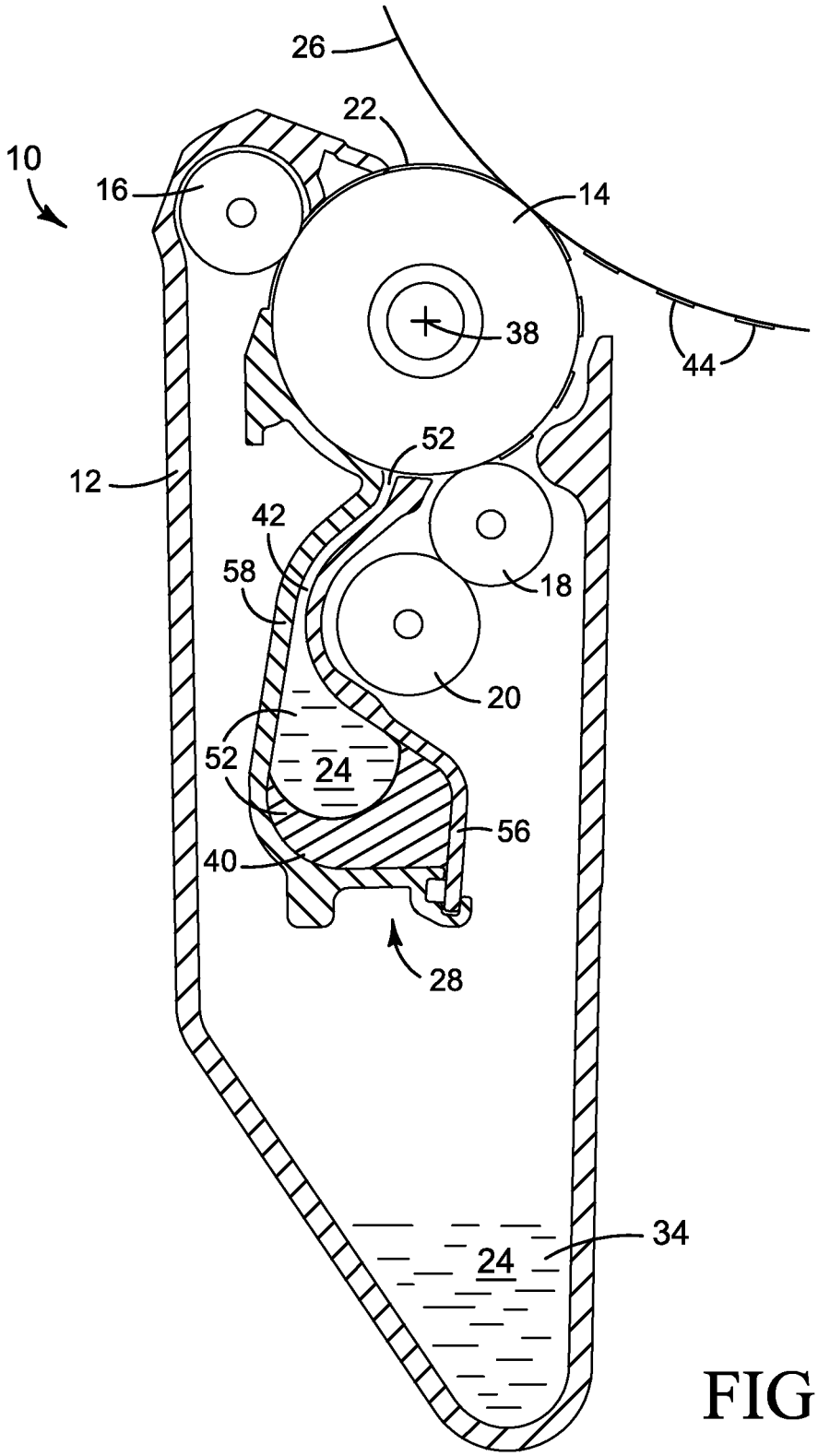

FIGS. 3 and 4 are example sections taken along the lines 3-3 and 4-4 in FIG. 1.

Figure 5:
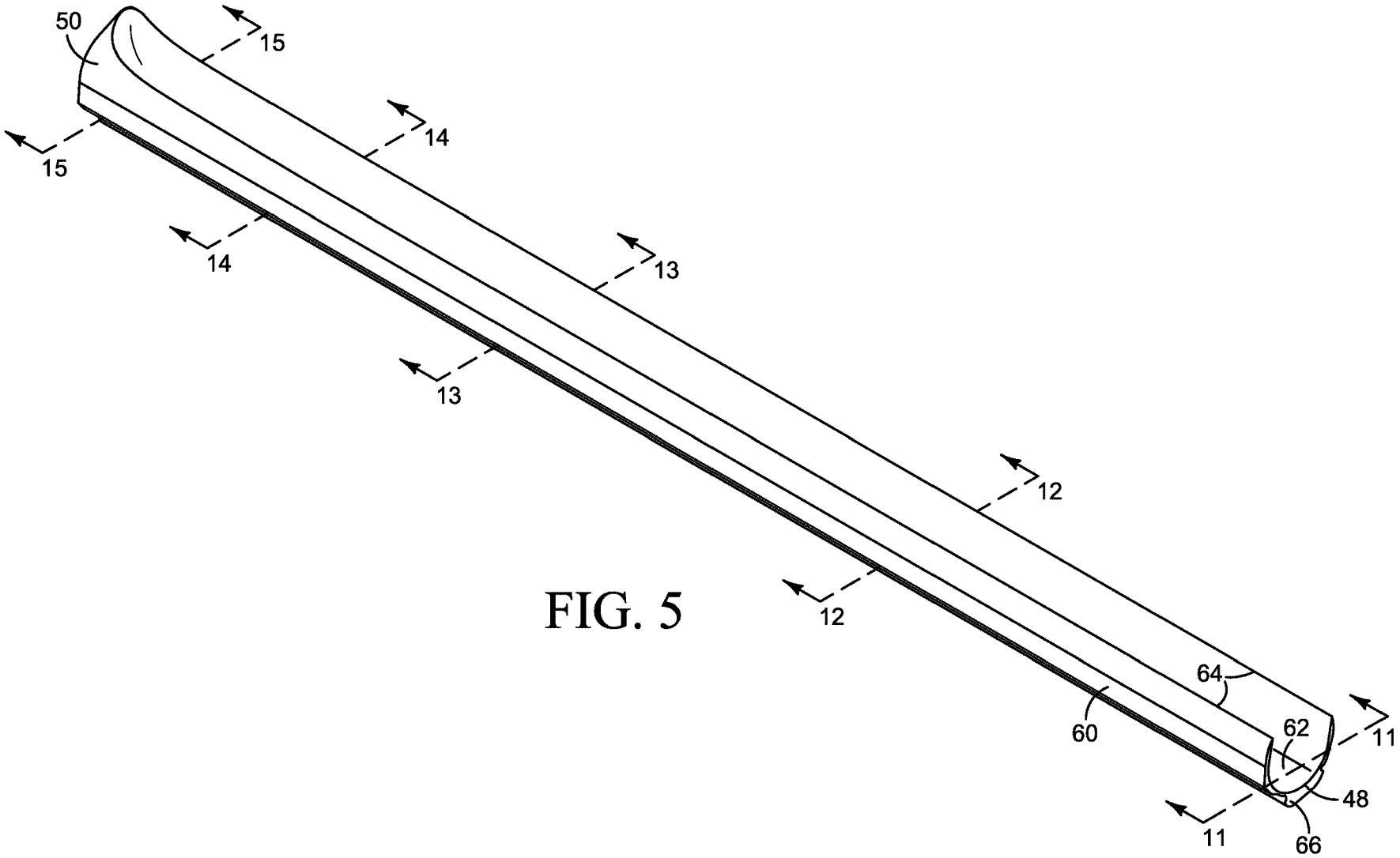
Figure 6:
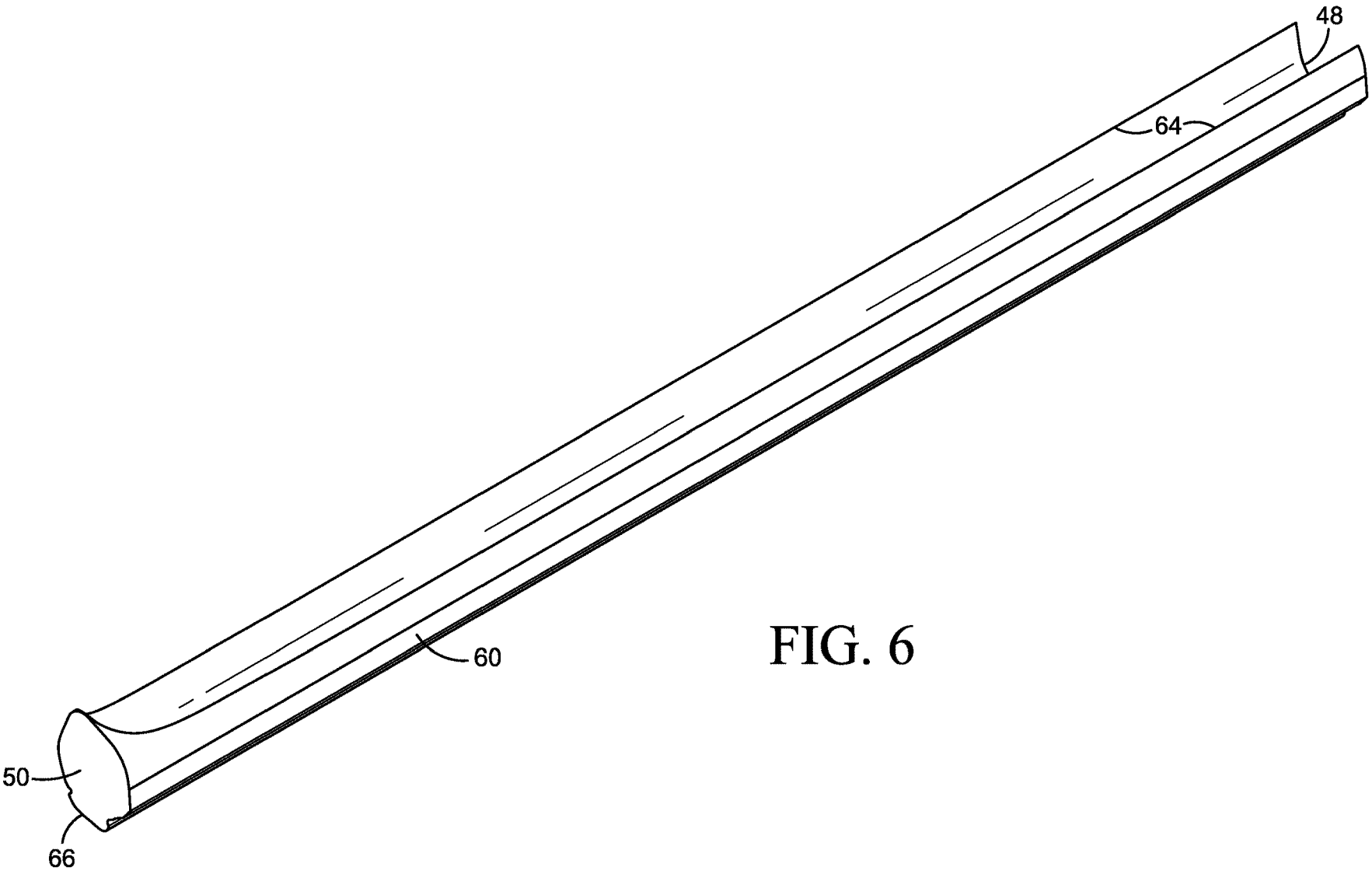

FIGS. 5 and 6 are isometrics illustrating one example of a basin for a developer unit ink flow structure such as the one shown in FIGS. 1-4.

Figure 7:
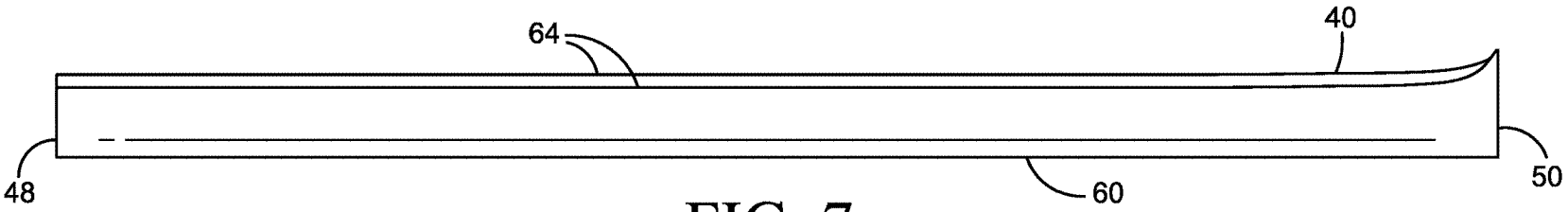
Figure 8:
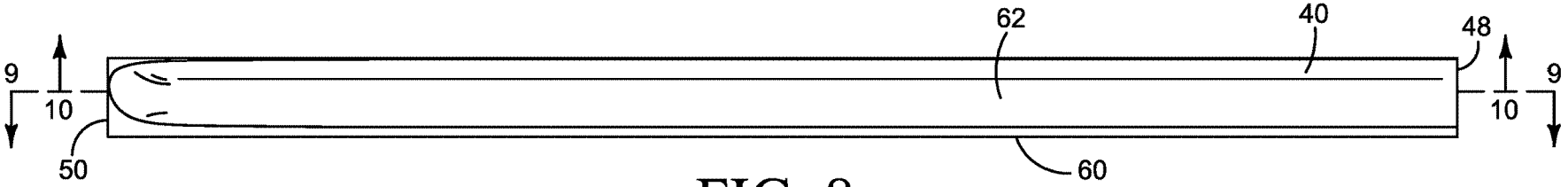

FIGS. 7 and 8 are elevation views of the example basin shown in FIGS. 5 and 6.

Figure 9:
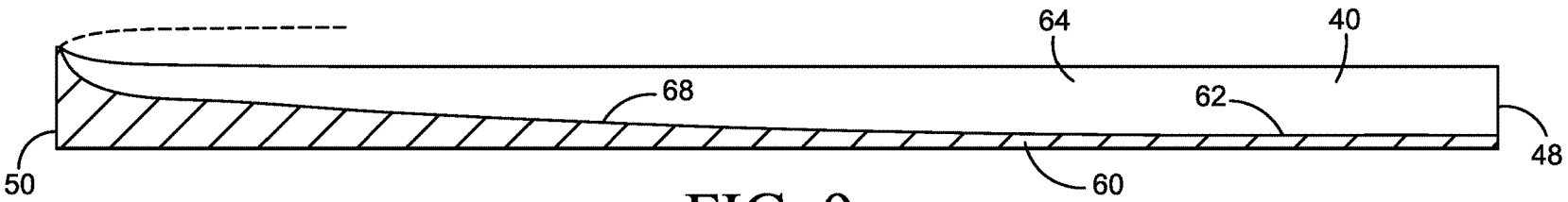
Figure 10:
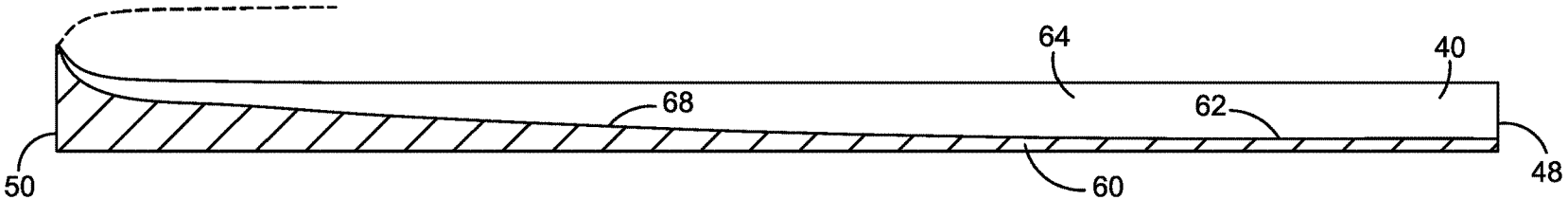

FIGS. 9 and 10 are lengthwise sections of the example basin shown in FIGS. 5-8.

Figure 11:
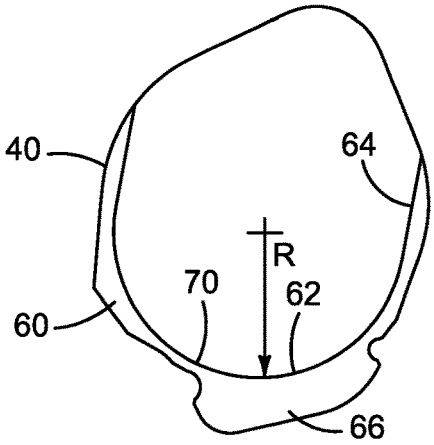
Figure 12:
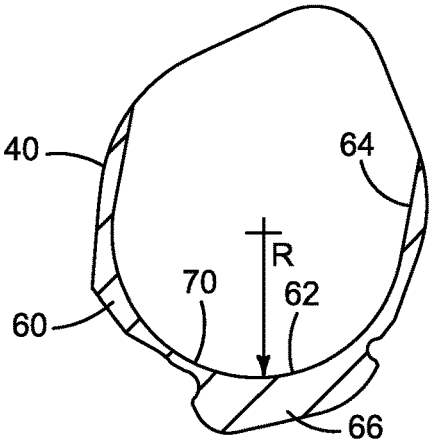
Figure 13:
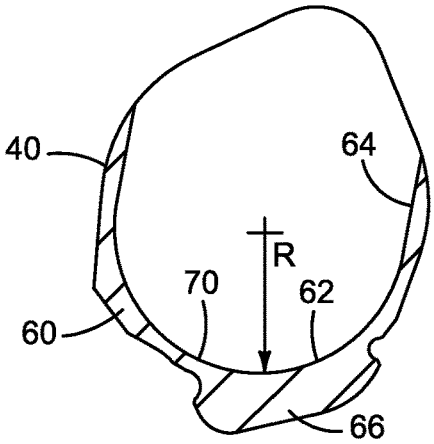
Figure 14:
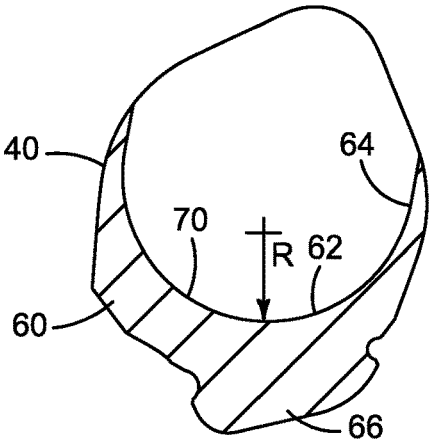
Figure 15:
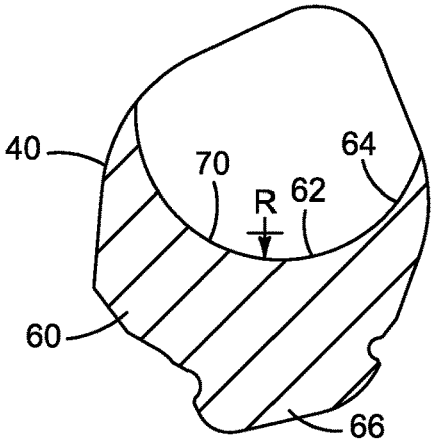

FIG. 11 is an elevation of the example basin shown in FIGS. 5-8.

FIGS. 12-15 are crosswise sections of the example basin shown in FIGS. 5-8.

Figure 16:
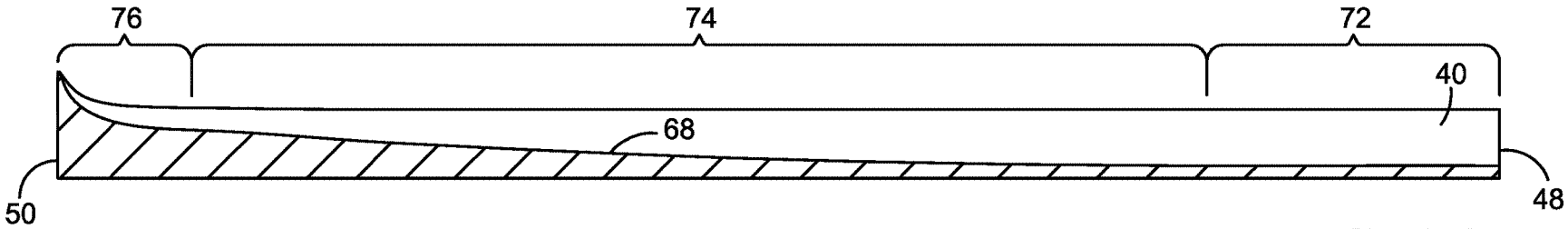

FIG. 16 is a lengthwise section illustrating an example of a basin for a developer unit ink flow structure.

Figure 17:
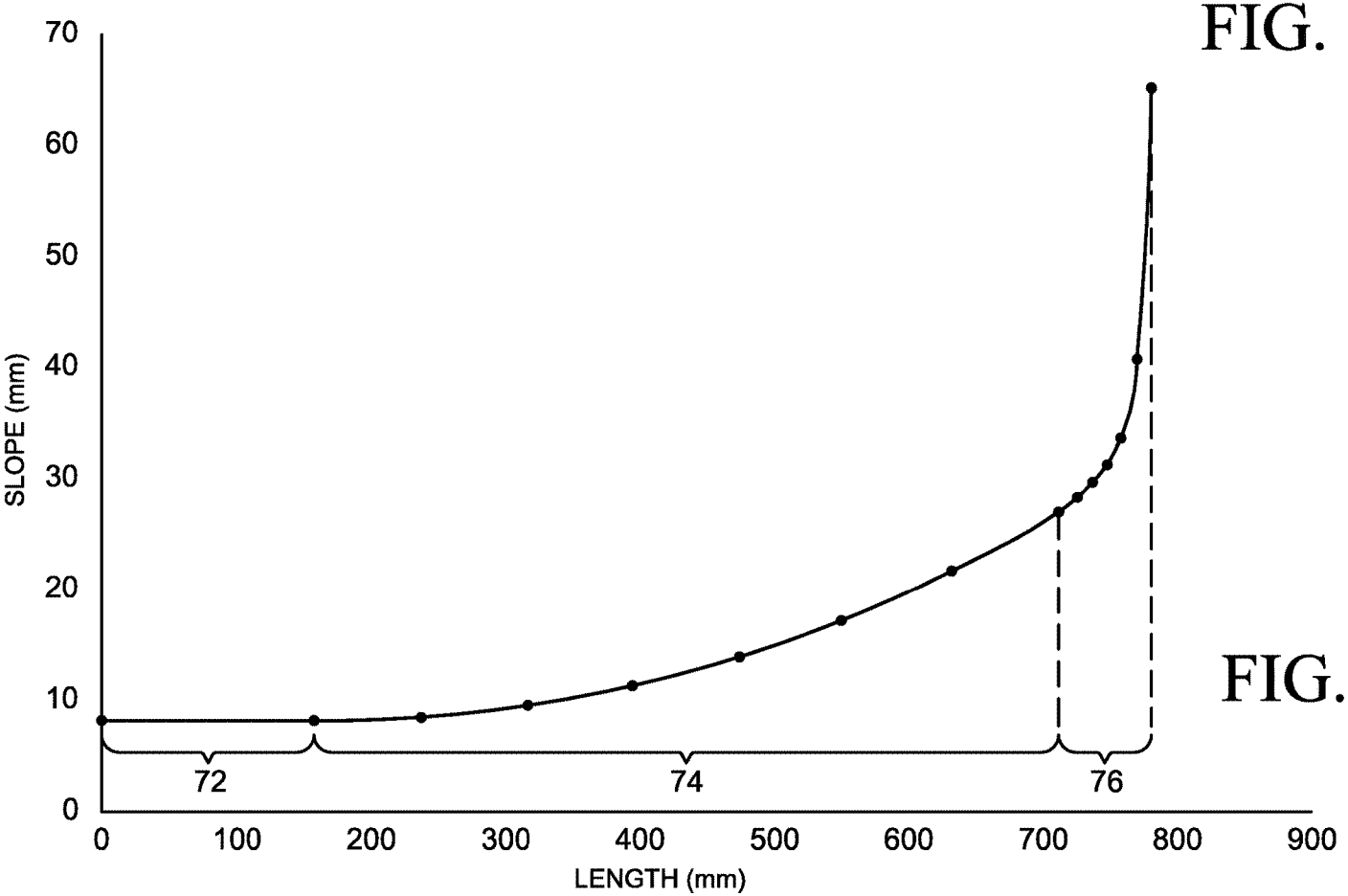

FIG. 17 is a graph illustrating a curved bottom for the example basin shown in FIG. 16.

The same part numbers designate the same or similar parts throughout the figures. The figures are not necessarily to scale.

DESCRIPTION

In liquid electrophotographic printing, a thin film of LEP ink is applied to a developer roller and then presented to a photoconductor at a nip between the developer roller and the photoconductor. Ink is pumped through an inlet into an elongated supply chamber in the developer unit. Ink flows up out of the chamber through a narrow winding channel that extends along the full length of the supply to chamber to the developer roller. The flow of ink can stagnate near the end of the supply chamber opposite the inlet. Ink sludge tends to accumulate in stagnant areas, inhibiting or even blocking ink flow to the developer roller. A new flow structure has been developed to help streamline the flow of ink through the supply chamber, to reduce stagnation and, thus, the accumulation of ink sludge.

In one example, the bottom of the supply chamber curves up from the inlet end to the downstream end to progressively shrink the volume of the chamber from a larger volume at the inlet end to a smaller volume at the closed end. In one implementation, the curve is parabolic with the focus of the parabola near the downstream end so that the shrinkage accelerates toward the downstream end of the chamber where the risk of stagnation is greater. Testing shows that the progressively shrinking volume along with the parabolic shape of the bottom streamlines the flow of ink through the chamber, inhibiting stagnation and allowing the ink to flow up into the channel more uniformly along the full length of the supply chamber.

These and other examples shown in the figures and described below illustrate but do not limit the scope of the patent, which is defined in the Claims following this Description.

Figure 2:
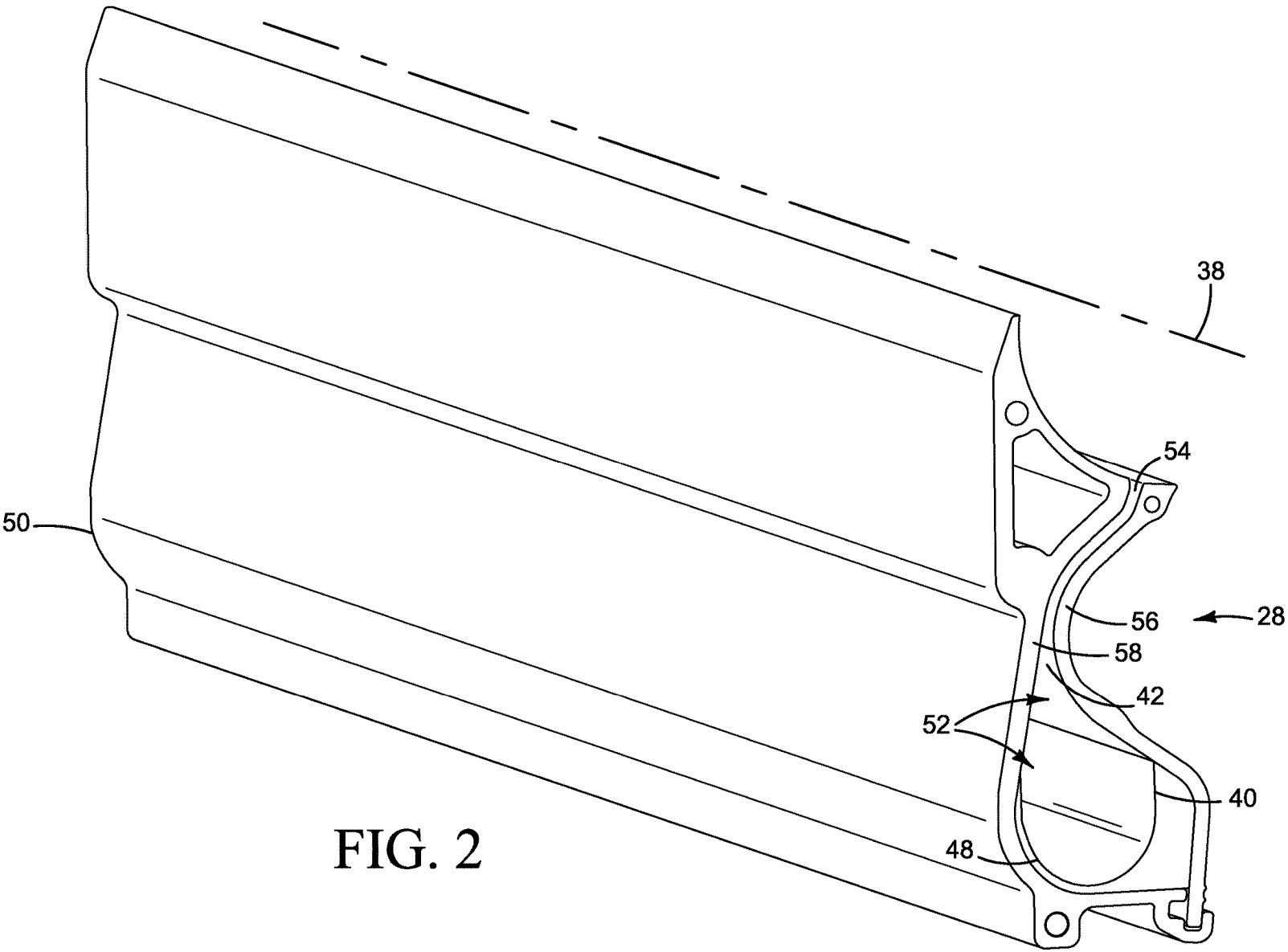
FIG. 2 is a detail of the example ink flow structure shown in FIG. 1.

FIG. 1 is an isometric illustrating a developer unit 10 for a liquid electrophotographic printer, implementing one example of a new ink flow structure. One of the end caps is exploded in FIG. 1 to reveal the ink flow structure. FIG. 2 is a detail of the example ink flow structure shown in FIG. 1. FIGS. 3 and 4 are example sections of developer unit 10 taken along the lines 3-3 and 4-4 in FIG. 1. A developer unit for an LEP printer is commonly referred to as a "binary ink developer" or a "BID." An LEP printer may include multiple BIDs, one for each color ink for example.

Referring to FIGS. 1-4, in this example developer unit 10 includes a housing 12 housing a developer roller 14, a squeegee roller 16, a cleaner roller 18, and a sponge roller 20. Developer roller 14 is exposed outside housing 12 to present a film 22 of LEP ink 24 to a photoconductor 26. LEP ink 24 is pumped into a flow structure 28, for example from an external reservoir 30, through an inlet 32. Also, excess ink 24 may be reclaimed and collected in a local return chamber 34 and returned to reservoir 30 through an outlet 36.

Developer roller 14 rotates on an axis 38 that extends lengthwise along unit 10. Ink flow structure 28 extends lengthwise under developer roller 14 parallel to axis 38 to supply ink to roller 14 along substantially the full length of the roller. Flow structure 28 includes a basin 40 and a channel 42. In operation, according to one example, ink is pumped into basin 40 and up through channel 42 to the electrically charged developer roller 14. A thin layer of ink is applied electrically to the surface of a rotating developer roller 14. Squeegee roller 16 rotates along developer roller 14 to squeegee excess carrier liquid from the ink on roller 14 while charged particles in the ink continue to adhere to developer roller 14.

The now more concentrated ink film 22 on developer roller 14 is presented to photoconductor 26 where some of the ink is transferred in the pattern of a latent electrostatic image on the photoconductor as the desired ink image 44. A charged cleaner roller 18 rotates along developer roller 14 to electrically remove residual ink from roller 14. In this example, cleaner roller 18 is scrubbed with a "sponge" roller 20 that is rotated against cleaner roller 18. Some of the ink residue may be absorbed into sponge roller 20 and some may fall away. Excess carrier liquid and ink drains to return chamber 34 where it can be recycled to reservoir 30.

Developer unit 10 includes end caps 46 attached to housing 12 to support each roller 14-20 on its respective shaft. In the example shown, end caps 46 close the upstream end 48 and the downstream end 50 of ink flow structure 28 (except at inlet 32). In other examples, ends 48, 50 may be closed by end pieces integral to the flow structure or end pieces attached to the flow structure distinct from the end caps. Flow structure 28 thus defines an internal chamber 52 with an inlet 32 at one end of basin 40 through which ink may enter the chamber, and an outlet 54 along the length of channel 42 through which ink may leave the chamber. Ink enters chamber 52 through inlet 32 and flows into and along basin 40, then up through channel 42 and out outlet 54 at the urging of a pressure difference between inlet 32 and outlet 54.

In the example shown, channel 42 forms a narrow winding flow path from basin 40 to developer roller 14 to increase the flow rate of ink out of basin 40 into and through channel 42 to outlet 54 at the desired location on developer roller 14. Channel 42 may be made of metal or another suitably conductive material to function as an electrode along the interface with developer roller 14 to help form ink film 22 on roller 14. Basin 40 may be made of plastic or another suitably non-conductive material to help repel sludge and reduce cost. In this example, channel 42 is formed by two discrete parts 56, 58 and basin 40 is formed as an insert fitted into channel parts 56, 58. Other suitable materials and configurations for basin 40 and channel 42 in flow structure 28 are possible. For example, it may be desirable in some applications to form basin and 40 and channel 42 together as an integral unit, rather than as separate parts.

The volume of basin 40 shrinks from a larger volume at upstream end 48 at ink inlet 32 to a smaller volume at downstream end 50, as best seen by comparing the crosswise sections of basin 40 in FIGS. 3 and 4. As described below with reference to FIGS. 5-15, a basin 40 with a parabolic or other suitably curved bottom that shrinks the volume of the basin progressively from the upstream end to the downstream end has been shown to streamline the flow of ink to inhibit stagnation, allowing ink to flow up into channel 42 more uniformly along the full length of supply chamber 52.

FIGS. 5-15 illustrate one example of a basin 40 such as might be used in a developer unit 10 shown in FIGS. 1-4. Referring to FIGS. 5-15, basin 40 may be characterized as having a body 60, a bottom 62, and sidewalls 64. In this example, basin 40 includes a key 66 that protrudes from body 60 to fit into a mating keyway on the developer unit to properly locate and secure basin 40 as an insert, for example into electrode channel parts 56, 58 shown in FIGS. 1-4. Basin bottom 62 curves up lengthwise from upstream, inlet end 48 to downstream end 50 along a curve 68, as best seen in the lengthwise sections of FIGS. 9 and 10. Basin bottom 62 also curves crosswise between sidewalls 64 along a curve 70, as best seen in the elevation of FIG. 11 and the crosswise sections of FIGS. 12-15.

A basin bottom 62 curving up from inlet end 48 lengthwise shrinks the volume of basin 40 progressively from end 48 to end 50, with the shrinkage accelerating toward end 50. In one example, lengthwise curve 68 is parabolic. In this example, as best seen in FIGS. 9 and 10, curve 68 forms relatively narrow parabolas to slope less steeply away from end 50 to maintain a suitable vertical profile over the length of flow structure 28 that fits within the space constraints of developer unit 10 (FIGS. 1-4). In one example, crosswise curve 70 is circular, with a radius R, as best seen in FIGS. 11-15. A circular crosswise curve 70 enables the lengthwise curve 68 to change uniformly moving away from the middle of the crosswise curve in each direction up toward sidewalls 64 and helps maintain a uniform flow rate toward channel 42.

In the example shown in FIGS. 16 and 17, lengthwise curve 68 includes a shorter flat, straight part 72 near the inlet to basin 40, a longer, less steeply sloped parabolic part 74 through the middle of basin 40 and a shorter, more steeply sloped parabolic part 76 at downstream end 50 of basin 40. The length and relative slope of each part 72-76 is illustrated in the graph of FIG. 17 for an example basin 40. Testing shows that this type of composite basin curve 68 streamlines the flow of ink along basin 40 and up into channel 42 (FIGS. 1-3) and reduces stagnation at the downstream end 50 of basin 40.

As noted above, the examples shown in the figures and described herein illustrate but do not limit the scope of the patent, which is defined in the following Claims.

"A", "an" and "the" used in the claims means one or more.

The invention claimed is:

1. A flow structure for an ink supply in a liquid electrophotographic developer unit, the structure comprising an elongated basin having a volume that shrinks lengthwise progressively from an upstream part of the basin near an inlet to the basin to a downstream part of the basin away from the inlet such that a rate of lengthwise shrinkage increases towards the downstream part.

2. The structure of claim 1, where a bottom of the basin is curved along a lengthwise section.

3. The structure of claim 2, where the bottom of the basin is parabolic along the lengthwise section.

4. The structure of claim 2, where the bottom of the basin is curved across a crosswise section.

5. The structure of claim 4, where the bottom of the basin is circular across the crosswise section.

6. An ink flow structure for a liquid electrophotographic developer unit, comprising:

a basin having a bottom extending lengthwise along a curve from a first, inlet end of the basin to a second end of the basin opposite the first end; and a channel having a first, broader part opening into the basin and converging to a second, narrower part away from the basin, the broader part of the channel extending straight along the length of the basin and the narrower part of the channel winding laterally away from the basin.

7. An ink developer unit for a liquid electrophotographic printer, comprising:

a developer roller rotatable about a lengthwise axis;

an ink flow structure extending lengthwise parallel to the axis, the supply structure defining an ink flow path that includes:

a basin extending lengthwise along a bottom part of the structure from a first end through which ink may enter the basin to a second end opposite the first end; and a channel extending lengthwise along a top part of the structure and communicating with the basin to form an uninterrupted ink flow path from the basin to the developer roller; and where a bottom of the basin extends lengthwise along a first curve such that a volume of the basin shrinks from the first end to the second end.

8. The developer unit of claim 7, where the bottom of the basin curves up from a lower part near the first end to a higher part at the second end.

9. The developer unit of claim 8, where the first curve is a parabola.

10. The developer unit of claim 7, where the bottom of the basin extends crosswise around a second curve different from the first curve.

11. The developer unit of claim 10, where the second curve is circular.

12. The developer unit of claim 7, where the curved part of the basin and the channel are formed by discrete parts of the supply structure.

13. The developer unit of claim 7, where the curved part of the basin is formed by a non-conductive part of the supply structure and the channel is formed by a conductive part of the supply structure.

* * * * *